US006220836B1

(12) United States Patent
Wu

(10) Patent No.: US 6,220,836 B1
(45) Date of Patent: Apr. 24, 2001

(54) CLAMP DEVICE FOR A HAND AIR PUMP

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/301,030

(22) Filed: Apr. 28, 1999

(30) Foreign Application Priority Data

Jun. 17, 1998 (TW) ..... 87209621

(51) Int. Cl.[7] ..... F04B 39/00
(52) U.S. Cl. ..... 417/572; 417/467; 137/231
(58) Field of Search ..... 417/572, 570, 417/555.1, 554, 440, 531, 467; 137/231, 118.03, 150, 15.17, 15.08, 315.35, 454.2, 512.15; 251/149.4, 149.6, 149.1; 92/58.1, 63

(56) References Cited

U.S. PATENT DOCUMENTS 3,592,439 * 7/1971 Ritchie ..... 251/149.6
4,017,057 * 4/1977 Strybel ..... 251/149.1
4,063,708 * 12/1977 Smith ..... 251/149.4
4,328,948 * 5/1982 Pearl, II ..... 251/149.6
5,819,781 * 10/1998 Wu ..... 137/231
5,975,109 * 11/1999 Wu ..... 137/231
5,983,920 * 11/1999 Gapinski et al. ..... 137/231
6,135,733 * 10/2000 Wu ..... 417/467

* cited by examiner

*Primary Examiner*—Teresa Walberg
*Assistant Examiner*—Quang Van
(74) *Attorney, Agent, or Firm*—Alan Kamrath; Rider Bennett Egan & Arundel, LLP.

(57) ABSTRACT

A clamp device for a hand air pump includes a sleeve including a first end securely attached to an output end of a cylinder of the hand air pump and a second end for receiving a valve of an article to be inflated, a plug mounted in the sleeve, a protective ring mounted between the sleeve and the plug such that the plug does not move when the sleeve rotates, and a nozzle communicating the output end of the cylinder with an interior of the sleeve.

7 Claims, 5 Drawing Sheets

CLAMP DEVICE FOR A HAND AIR PUMP

BACKGROUND OF THE INVENTION

1. Field of the Invention

The present invention relates to a clamp device for a hand air pump that has a protective ring to avoid damage to a rubber sealing plug of the clamp device.

2. Description of the Related Art

FIG. 7 of the drawings illustrates a conventional clamp device attached to a hand air pump 1 for holding a valve 90 of an article (e.g., a bicycle tire) to be inflated. The clamp device includes a sleeve 82, a rubber plug 81 mounted in the sleeve 82, a nozzle 83 communicating an interior of the rubber plug 81 with the hand air pump 1, and an end cap 80 that holds the tire valve 90. In use, the sleeve 82 is rotated to be in threading engagement with the valve 90 such that the rubber plug 81 that provides a sealing effect for inflation tends to wear and thus be damaged. The present invention is intended to provide an improved clamp device to solve this problem.

SUMMARY OF THE INVENTION

It is a primary object of the present invention to provide an improved clamp device that has a protective ring mounted between the sleeve and the rubber sealing plug to protect the rubber sealing plug.

In accordance with the present invention, a clamp device is provided for a hand air pump. The clamp device comprises a sleeve including a first end securely attached to an output end of a cylinder of the hand air pump and a second end for receiving a valve of an article to be inflated, a plug mounted in the sleeve, a protective ring mounted between the sleeve and the plug such that the plug does not move when the sleeve rotates, and a nozzle communicating the output end of the cylinder with an interior of the sleeve.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
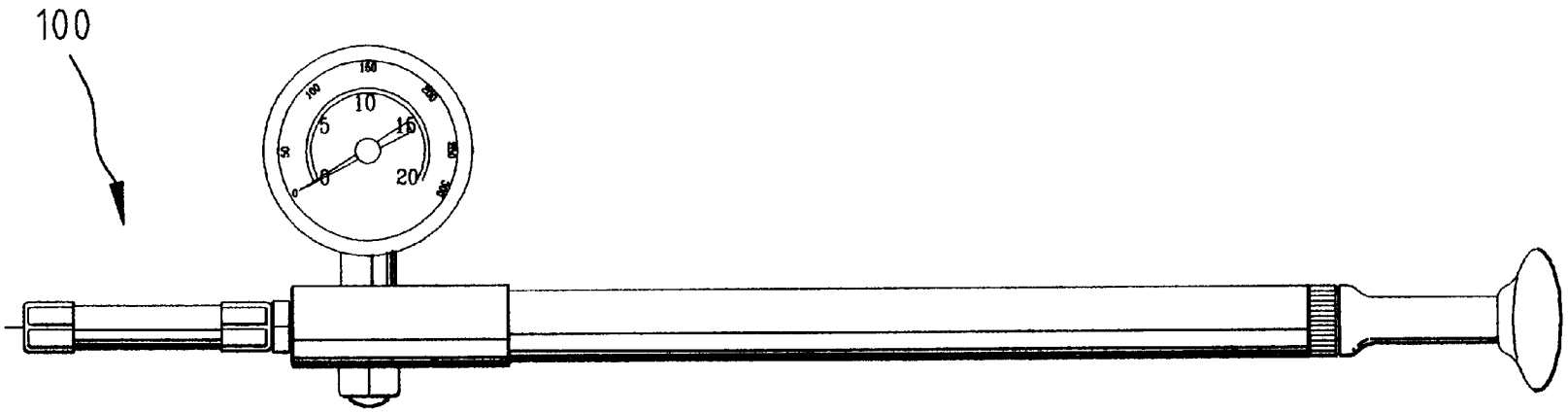
FIG. 1 is an elevational view of a hand air pump with a clamp device in accordance with the present invention.
Figure 2:
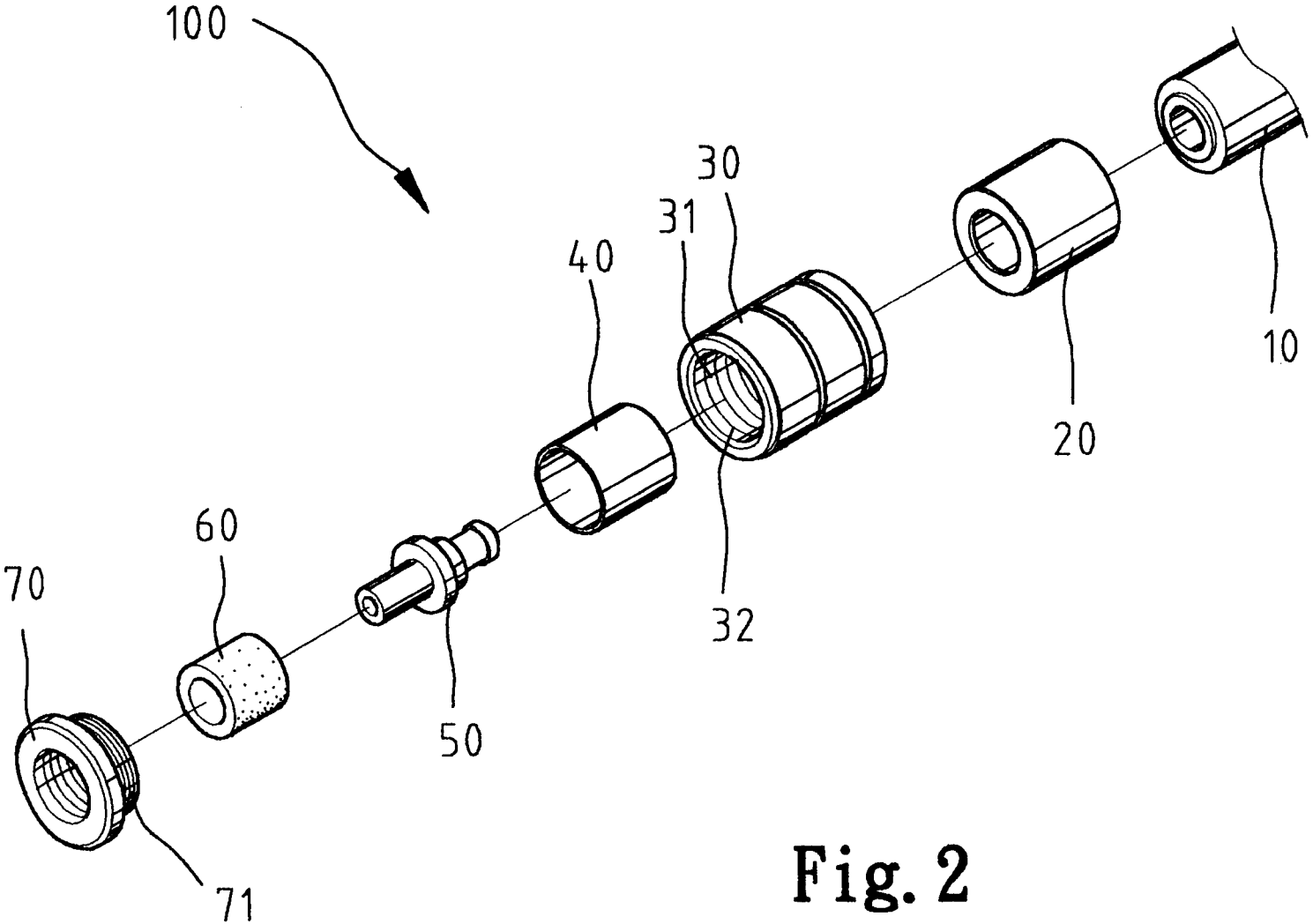
FIG. 2 is an exploded perspective view of the clamp device in accordance with the present invention.
Figure 3:
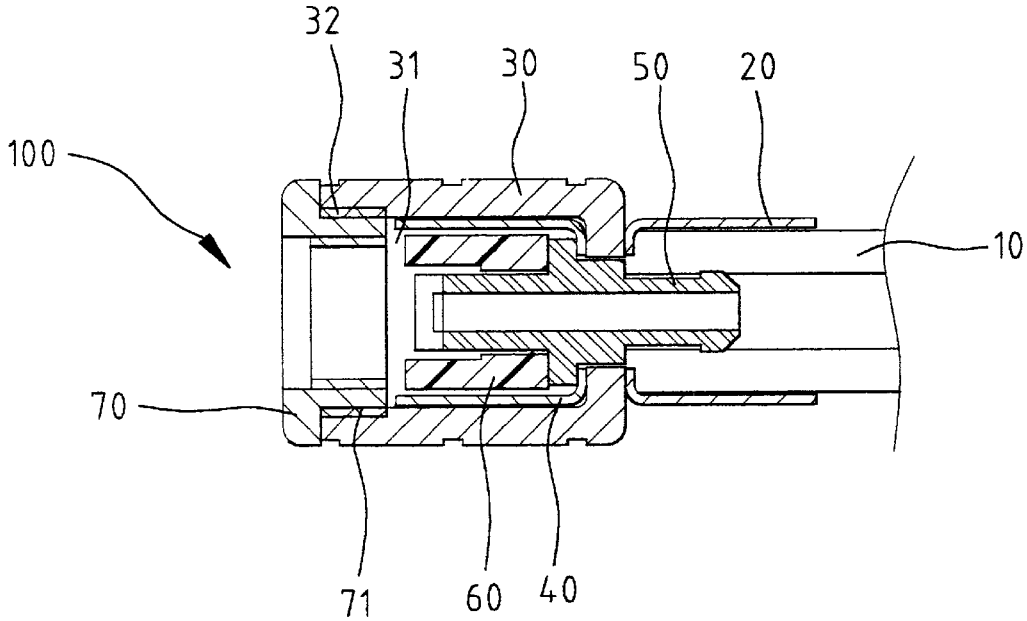
FIG. 3 is a partial sectional view of the clamp device in accordance with the present invention and a portion of a hand air pump.

Referring to the drawings and initially to FIGS. 1 through 3, a clamp device 100 in accordance with the present invention generally includes a cylinder holder 20 mounted around an output end of a cylinder 10 of a hand air pump, a sleeve 30 having an end attached to the cylinder holder 20, and an end cap 70 mounted to the other end of the sleeve 30. In this embodiment, the sleeve 30 includes a threaded section 32 for engaging with outer threading 71 of the end cap 70. A plug 60, preferably made of rubber, is mounted in the sleeve 30, and a protective ring 40 is mounted between the plug 60 and the sleeve 30. In addition, a nozzle 50 includes a first end received in the output end of the cylinder 10 and a second end received in the plug 60 to communicate an interior of the output end of the cylinder 10 and an interior 31 of the sleeve 30.

Figure 4:
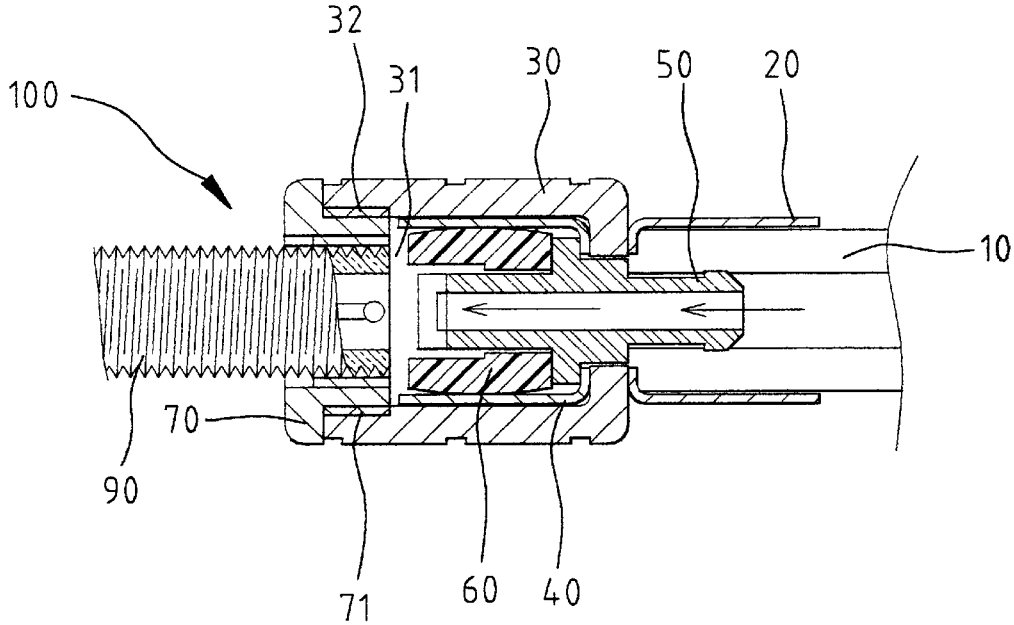
FIG. 4 is a sectional view similar to FIG. 3, wherein a tire valve is held by the clamp device in accordance with the present invention.
Figure 5:
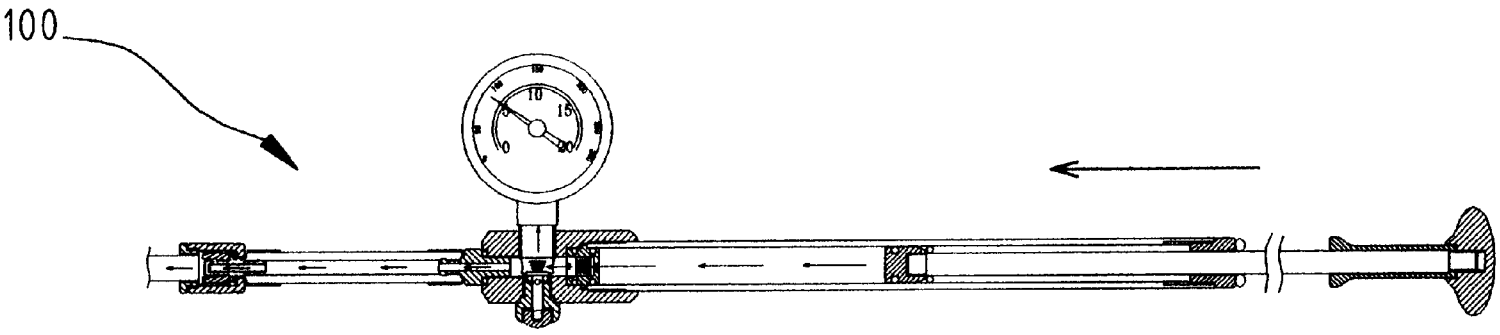
FIG. 5 is a sectional view of the hand air pump, illustrating an inward stroke of the piston.
Figure 6:
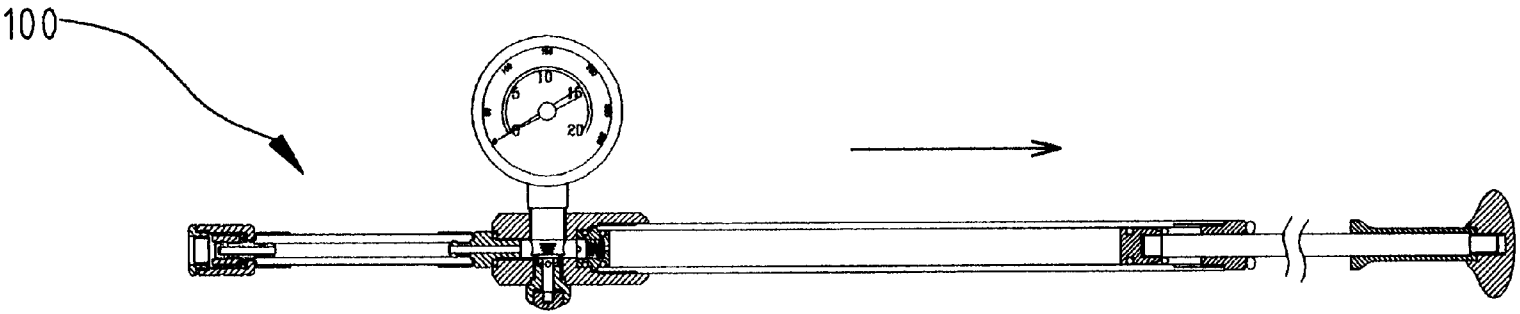
FIG. 6 is a sectional view of the hand air pump, illustrating an outward stroke of the piston.
Figure 7:
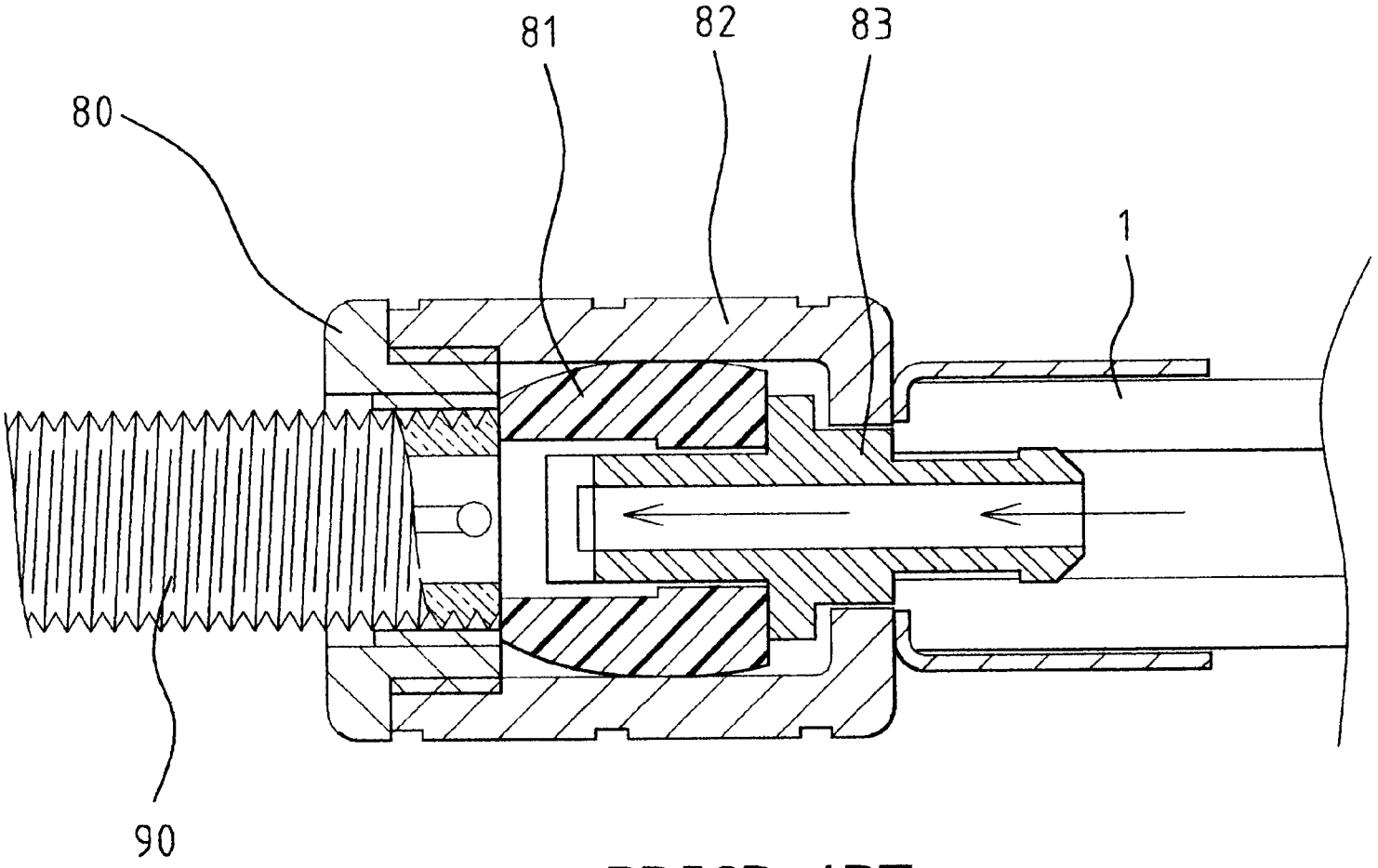
PRIOR ART Fig. 7
FIG. 7 is a partial sectional view of a conventional clamp device and a portion of a hand air pump.

In use, referring to FIG. 4, a valve 90 of an article (e.g., a bicycle tire) to be inflated is inserted into the end cap 70 and thus causes deformation of the rubber plug 60. The sleeve 30 is rotated to provide secure engagement with the valve 90. The protective ring 40 rotates together with the sleeve 30. Nevertheless, the plug 60 neither rotates nor slides. Namely, the plug 60 does not move. Thus, wear to the plug 60 is avoided. This is advantageous as the plug 60 provides a sealing effect during inflation, which is conventional and therefore not described in detail. FIGS. 5 and 6 illustrate the inflation operation of the hand air pump, which is conventional and therefore not described in detail.

Although the invention has been explained in relation to its preferred embodiment, it is to be understood that many other possible modifications and variations can be made without departing from the spirit and scope of the invention as hereinafter claimed.

What is claimed is:

1. A clamp device for a hand air pump having a cylinder with an output end, comprising:

a sleeve including a first end securely attached to the output end of the cylinder and a second end adapted to receive a valve of an article to be inflated, the sleeve having an interior;

a plug mounted in the sleeve;

a protective ring mounted between the sleeve and the plug and extending for a full axial length of the plug such that the plug does not move when the sleeve rotates; and a nozzle communicating the output end of the cylinder with the interior of the sleeve.

2. The clamp device as claimed in claim 1, wherein the second end of the sleeve includes an end cap attached thereto.

3. The clamp device as claimed in claim 2, wherein the protective ring extends greater than the full axial length of the plug.

4. The clamp device as claimed in claim 3, wherein the protective ring includes a radially inward extending lip captured between the nozzle and the sleeve.

5. The clamp device as claimed in claim 1, wherein the protective ring extends greater than the full axial length of the plug.

6. The clamp device as claimed in claim 5, wherein the protective ring includes a radially inward extending lip captured between the nozzle and the sleeve.

7. The clamp device as claimed in claim 1, wherein the protective ring includes a radially inward extending lip captured between the nozzle and the sleeve.

* * * * *